US005255391A

United States Patent [19]

Levine

[11] Patent Number: 5,255,391

[45] Date of Patent: Oct. 26, 1993

[54] KNEE PAD

[76] Inventor: Norman D. Levine, P.O. Box 1867, Pompano Beach, Fla. 33061

[21] Appl. No.: 892,269

[22] Filed: Jun. 2, 1992

[51] Int. Cl.[5] ..... A41D 13/06

[52] U.S. Cl. ..... 2/24; 2/911

[58] Field of Search ..... 2/16, 22, 24, 59, 62, 2/DIG. 6, 2, 170; 602/20, 21, 23, 26

[56] References Cited

U.S. PATENT DOCUMENTS

| | | | |
|---|---|---|---|
| D. 239,220 | 3/1976 | Norman | 2/16 |
| 1,081,245 | 12/1913 | McCall | 2/24 |
| 3,458,867 | 8/1969 | Moore et al. | 2/16 |
| 3,463,147 | 8/1969 | Stubbs | 602/26 |
| 3,575,166 | 4/1971 | Rosman | 2/22 |
| 3,786,804 | 1/1974 | Lewis | 2/24 |
| 3,804,084 | 4/1974 | Lehman | 602/26 |
| 4,041,940 | 8/1977 | Frankel et al. | 2/24 |
| 4,120,052 | 10/1978 | Butler | 2/24 |
| 4,198,708 | 4/1980 | Fugere et al. | 2/24 |
| 4,494,247 | 1/1985 | Kelly | 2/16 |
| 4,723,322 | 2/1988 | Shelby | 2/22 |
| 4,953,569 | 9/1990 | Lonardo | 2/16 |
| 5,024,216 | 6/1991 | Shiono | 2/24 |
| 5,086,761 | 2/1992 | Ingram | 602/26 |

FOREIGN PATENT DOCUMENTS

| | | | |
|---|---|---|---|
| 2222068 | 10/1974 | France . | |
| 9203110 | 3/1992 | PCT Int'l Appl. | 602/26 |

*Primary Examiner*—Clifford D. Crowder
*Assistant Examiner*—Amy B. Vanatta
*Attorney, Agent, or Firm*—Malin, Haley, DiMaggio & Crosby

[57] ABSTRACT

A pad for protecting the knee area of a wearer while engaging in activities such as snowboarding, skating, or the like, the pad comprising an elastic, waterproof body portion of nominal wall thickness and low weight, generally configured in a concave shape to comfortably fit over the knee area and around the leg of the wearer, the body portion having an internally disposed resilient member attached thereto for cushioning loads during forward falls, and integral provisions for releasably securing the pad around the wearer's leg in a snug fit, the releasable attachment provisions generally comprising two pairs of transversely disposed flaps unitarily formed in the body portion, one of each pair of flaps having loop material on one face thereof and a slot extending therethrough, and the other of each pair having an attached elongated planar strap, each strap having hook and loop material on opposing faces thereof, the entire configuration adapted for overlapping engagement.

8 Claims, 3 Drawing Sheets

KNEE PAD

BACKGROUND OF THE INVENTION

1. Field of the Invention

This invention relates generally to protective gear for snowboard riders, in-line skaters and ice skaters, and, more particularly, to a knee pad which provides a lightweight protective structure capable of shielding the area from potential injurious falls.

2. Description of the Prior Art

Snowboarding is presently the fastest growing alpine winter sport in the United States and abroad. With a greater number of ski areas permitting snowboarders to share the same lift serviced terrain as downhill skiers, the number of active participants has mushroomed, particularly in the under 25 years of age group. Snowboarding is analogous to "surfing on the snow." The snowboarder typically wears either "soft-shell" or "rigid-shell" boots, similar to those used with downhill ski equipment, either of which are rigidly secured to a pair of plate bindings, the forward one disposed generally axially and the rear one disposed transverse on the upper surface of the board. Unlike downhill ski equipment which utilizes releasable bindings that are actuated upon the skier's leg encountering a given twisting or pulling load during a fall, snowboard bindings do not release unless manually activated by the snowboarder when removal of the board is desired. Consequently, the snowboard is always anchored to the rider's feet during use. The reason for the design discrepancy between downhill ski equipment and snowboards is apparent in the geometry of the equipment. Skis are typically elongated, having a very high aspect ratio, i.e., the length of the ski in proportion to its width. Thus, when a skier falls, the long ski length facilitates the generation of a large torque or twisting moment at the interface between the skier's boot and the ski which, if not eliminated by release of the boot from the ski, can easily result in serious leg injuries. Moreover, each ski may be following a mutually exclusive path of travel during the fall. In contrast, because a snowboard has a relatively short aspect ratio, and since both legs are attached to one board, the types of falls encountered by a snowboarder are markedly different from those a downhill skier may face. Thus, the likelihood of leg injuries due to twisting, such as typically encountered in downhill skiing, are not a real concern. Unfortunately, the snowboarder must contend with a different type of fall, one which results in the rider falling forward upon his or her knees and arms, and the other in which the rider falls over backwards upon his or her posterior. It is the former which can result in severe pain and/or injury to an unprotected knee, and to which the present invention is directed. Similar types of falls are also common while using in-line or ice skates.

There is no protective gear presently available on the market which is capable of providing a snowboard rider with a lightweight, removable pad which may be comfortably worn on the wearer's legs around the knee area to reduce the likelihood of painful, serious knee injuries.

SUMMARY OF THE INVENTION

In accordance with the instant invention, there is disclosed a knee pad to be worn by a snowboard rider, in-line skater, or ice skater to reduce the likelihood of knee injuries during forward falls. The pad essentially comprises: an elastic, waterproof body portion of nominal thickness which is configured to be worn around the leg and over the knee area of the wearer; means for cushioning the area from impact which is integral with the body portion; and means for releasably securing the body portion in place.

The body portion is preferably fabricated from neoprene or an equivalent waterproof, elastic material having similar characteristics. Accordingly, the elasticity provides control of the tightness and rigidity of the entire structure, which may be fabricated in varying sizes to suit the particular user. The structure is defined by generally concave inner and outer surfaces which are bounded by a plurality of elongated side edges, geometrically oriented to define integral flaps which function as a means of securing the body portion around the wearer's leg.

Disposed integral with, and rigidly attached to the body portion, are means for cushioning the knee area from impact which essentially comprise a resilient member fabricated from a material such as elastic foam, which is rigidly attached to the body portion on one side thereof by an overlapping patch of elastic material, preferably by peripheral stitching.

To facilitate ease of use, the pad has simple quick release means which comprise a pair of patches of hook material which are rigidly attached and integral with one side of the body portion near each end thereof; two pairs of the aforementioned flaps, transversely disposed and unitarily formed in the body portion proximal to opposing ends thereof, one flap at each end having loop material disposed on one face thereof, and a slot extending through the loop material and the corresponding flap, respectively; and a pair of elongated planar straps, each ridigly attached to one of the pairs of first and second straps, each strap having hook and loop material disposed on opposing faces thereof, whereby the pairs of flaps may be wrapped around the leg of the wearer and the straps may be inserted through the slots such that the loop material on the straps releasably engages the patches of hook material on the body portion, and the loop material on the flaps releasably engages the hook material on one side of each of the elongated straps. In this manner, the knee pad may be adjustably worn around the wearer's leg and easily removed by simply pulling apart the respective engaged flaps and straps.

In accordance with the instant invention, it is an object thereof to provide a pad for protecting the knee area of a snowboarder from injurious falls.

It is a further object of the present invention to provide a pad for protecting the knee area of a snwboarder which is fabricated from an elastic, waterproof material.

It is yet another object of the instant invention to provide a pad for protecting the knee area of the snowboarder which is lightweight, comfortable, and capable of economic fabrication.

In accordance with these and other objects which will become apparent hereinafter, the instant invention will now be described with particular reference to the accompanying drawings.

DETAILED DESCRIPTION OF THE PREFERRED EMBODIMENT

Figure 1:
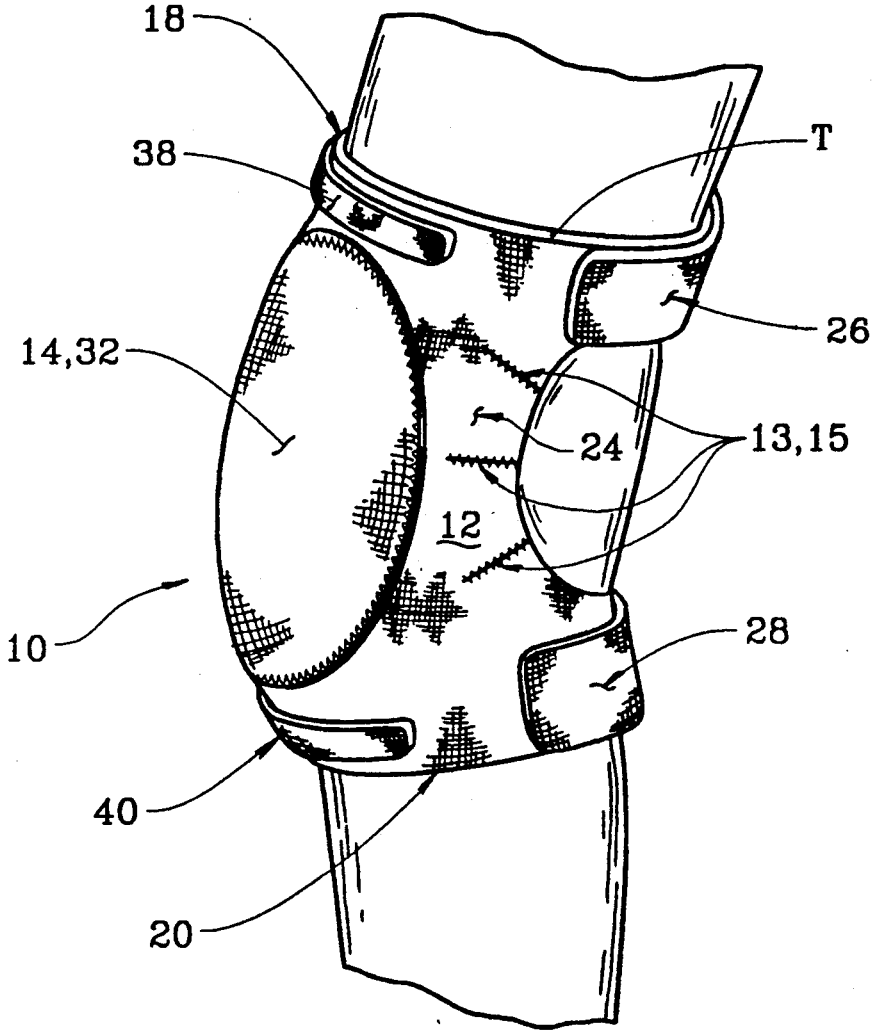
FIG. 1 is an isometric view of the pad being worn around the knee area.

With particular reference to the several views of the drawings, there is depicted a knee pad for protecting the knee area of a wearer, generally characterized by the reference numeral 10, which comprises: an elastic, waterproof body portion 12, means for cushioning the knee area from impact 14, and means for releasably securing body portion 12 in place.

Body portion 12 is preferably fabricated from neoprene or an equivalent material having similar attributes such as elasticity and impermeability. The structure of body portion 12 includes first and second ends 18 and 20, respectively, and concave first and second sides 22 and 24, respectively, which define a nominal wall thickness T therebetween, the entire structure thereof being bounded by a plurality of elongated side edges. The configuration is adapted to comfortably fit over the knee area and around the leg as shown in FIG. 1, by slitting body portion 12 along a plurality of lines generally denoted by the reference numeral 13 and stitching thereover 15, such that body portion 12 assumes a generally concave profile. The elastic character of body portion 12 lends control and tightness to the entire structure, which may be constructed in varying sizes to suit the particular user. The elongated side edges are geometrically oriented to unitarily define two pairs of transversely disposed integral flaps, 26 and 26' proximal to first end 18, and 28 and 28' proximal to second end 20, which function as a means of securing body portion 12 around the wearer's leg, as will be discussed in greater detail hereinbelow.

Figure 2:
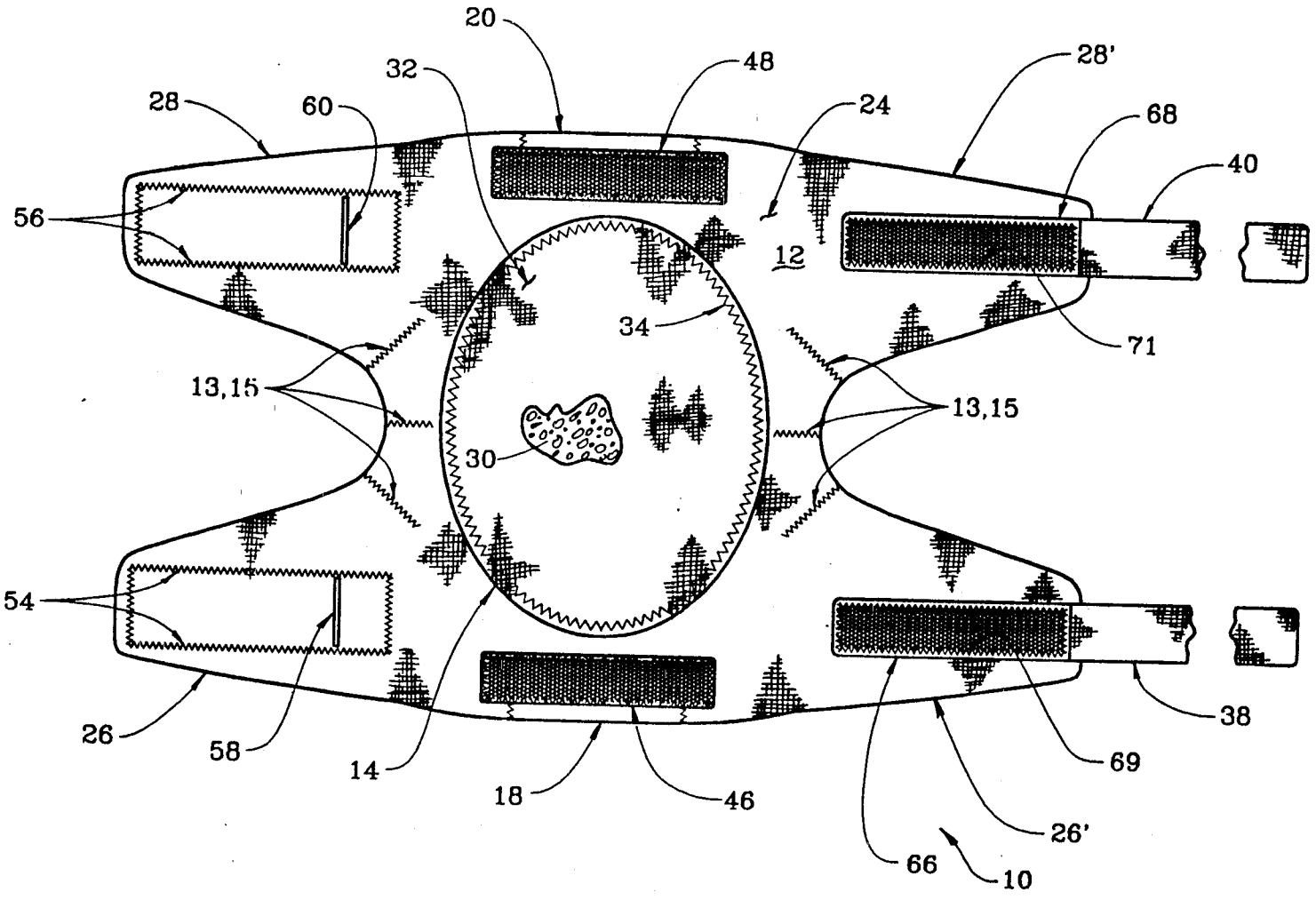
FIG. 2 is a plan view of the pad looking down on its outer surface.
Figure 3:
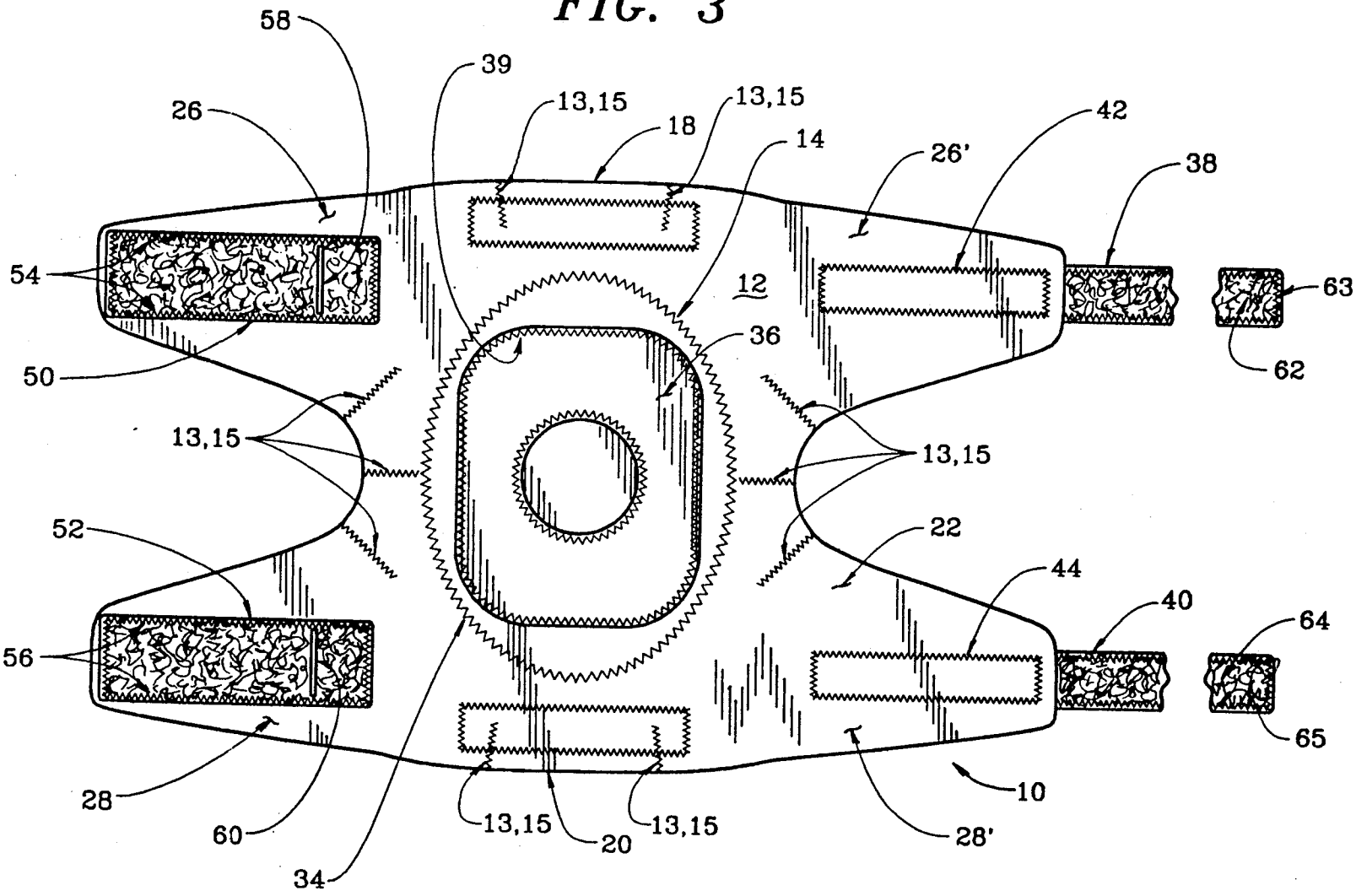
FIG. 3 is a plan view of the pad looking down on its inner surface.

Means for cushioning the knee area from impact 14 are disposed integral with body portion 12, proximal to the center thereof, as illustrated in FIGS. 2 and 3. Means for cushioning 14 essentially comprise a resilient member 30 preferably constructed from an elastic foam material which is rigidly secured to body portion 12 against second side 24 thereof by an overlapping patch of material 32 stitched thereto along stitch line 34. A flexible, neoprene member 36 of nominal wall thickness which integrally defines a generally circular aperture for receiving a kneecap therethrough is rigidly secured to body portion 12 on first side 22 thereof along stitch line 39 in general alignment with resilient member 30, and functions as an additional cushion and position locator for the knee area.

Knee pad 10 further includes means for releasably securing body portion 12 around the knee area and leg of the wearer, which comprise the aforementioned pairs of flaps 26 and 26', and 28 and 28', and elongated planar straps 38 and 40 which are rigidly attached to flaps 26' and 28' along stitch lines 42 and 44, respectively. Additionally, a first patch of hook material 46, and second patch of hook material 48, are rigidly attached to and integral with second side 24 of body portion 12 proximal to first end 18 and second end 20 thereof, respectively. Flaps 26 and 28 have patches of loop material 50 and 52 attached to first side 22 thereof along stitch lines 54 and 56, respectively. Flaps 26 and 28 define slots 58 and 60 which extend through body portion 12 and loop material patches 50 and 52, respectively. Elongated straps 38 and 40 have loop material 62 and 64 disposed on one face thereof along stitch lines 63 and 65, respectively, and hook material 66 and 68 on opposing faces attached along stitch lines 69 and 71, respectively, as shown in FIGS. 2 and 3. Pad 10 may be worn by wrapping each pair of flaps 26 and 26', and 28 and 28', around the leg of the wearer, and subsequently inserting elongated straps 38 and 40 through slots 58 and 60 such that loop material patches 50 and 52 overlap and engage hook material 66 and 68 on straps 38 and 40, respectively, and strap loop material 62 and 64 engage first and second patches of hook material 46 and 48, respectively. In this manner, pad 10 may be adjusted for the most comfortable fitting and wearing position.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. A knee pad for protecting the knee area of a wearer, comprising:

a body portion having first and second ends and first and second sides which define a nominal wall thickness therebetween, said body portion being bounded by a plurality of elongated side edges, said body portion adapted to fit over the knee area of said wearer;

means for cushioning said knee area during impact, rigidly secured to and integral with said body portion; and means for releasably securing said body portion over said knee area and around the leg of said wearer, said means for releasably securing including a pair of first and second transversely disposed flaps unitarily formed in said body portion proximal to each of said first and second ends, respectively, wherein one of said flaps in each pair has loop material disposed on one face thereof and defining a slot extending through said loop material and the corresponding flap, respectively, whereby said body portion first side and said means for cushioning are maintained in intimate association with said knee area by wrapping said means for releasably securing around said leg, thereby forming a protective structure which is capable of cushioning and protecting said knee area from potential injurious falls which could be sustained while riding a device such as a snowboard.

2. The knee pad recited in claim 1, wherein said means for releasably securing further includes:

a first patch of hook material rigidly attached to and integral with said second side of said body portion proximal to said first end thereof;

a second patch of hook material rigidly attached to and integral with said second side of said body portion proximal to said second end thereof; and a pair of elongated, planar strips, each rigidly attached to one of said pair of first and second flaps, respectively, each strap having hook material and loop material disposed on opposing faces thereof, whereby said pairs of first and second flaps may be wrapped around said leg of said wearer and said elongated planar straps may be inserted through said slots such that said loop material on said straps releasably engages said first and second patches of hook material on said body portion, respectively, and said loop material on one of said first and second flaps releasably engages said hook material on one side of each of said elongated, planar straps, thereby providing said knee pad with an adjustable fit around said wearer'leg.

3. The knee pad recited in claim 1, wherein said means for cushioning comprises a resilient member integral with said body portion and rigidly attached thereto.

4. The knee pad recited in claim 3, wherein said resilient member is fabricated from elastic foam and rigidly secured to said body portion second side by an overlapping patch of material stitched to said body portion second side.

5. The knee pad recited in claim 4, further comprising a flexible patch which integrally defines an aperture therethrough for receiving a kneecap, said flexible patch rigidly attached to said first side of said body portion in the center thereof, and disposed in general alignment with said elastic foam member.

6. The knee pad recited in claim 1, wherein said body portion is fabricated from a waterproof, elastic material.

7. The knee pad recited in claim 1, whereby said body portion is fabricated from neoprene.

8. A knee pad for protecting the knee area of a wearer, comprising:

a waterproof, elastic neoprene body portion having first and second ends and concave first and second sides which define a nominal wall thickness therebetween, said body portion being bounded by a plurality of elongated side edges, said body portion adapted to fit over the knee area of said wearer;

means for cushioning said knee area during impact, said means for cushioning comprising a resilient member rigidly secured to said body portion second side by an overlapping patch of material stitched to said body portion second side, said means for cushioning further comprising a flexible patch which integrally defines an aperture therethrough, said flexible patch rigidly attached to said first side of said body portion in the center thereof and disposed in general alignment with said resilient member; and means for releasably securing said body portion over said knee area and around the leg of said wearer, said means for releasably securing comprising: a first patch of hook material rigidly attached to and integral with said second side of said body portion proximal to said first end thereof; a second patch of hook material rigidly attached to and integral with said second side of said body portion proximal to said second end thereof; a pair of transversely disposed first flaps unitarily formed in said body portion proximal to said first end thereof, one of said pair of first flaps having loop material disposed on one face thereof, and defining a slot extending through said loop material and the corresponding flap, respectively; a pair of transversely disposed second flaps unitarily formed in said body portion proximal to said second end thereof, one of said pair of second flaps having loop material disposed on one face thereof, and defining a slot extending through said loop material and the corresponding flap, respectively; and a pair of elongated, planar straps, each rigidly attached to one of said pair of first and second flaps, respectively, each strap having hook material and loop material disposed on opposing faces thereof, whereby said pairs of first and second flaps may be wrapped around said leg of said wearer and said elongated planar straps may be inserted through said slots such that said loop material on said straps releasably engages said first and second patches of hook material on said body portion, respectively, and said loop material on one of said first and second flaps releasably engages said hook material on one side of each of said elongated planar straps, whereby said body portion first side and said means for cushioning are maintained in intimate association with said knee area by wrapping said means for releasably securing around said leg, thereby forming a protective structure which is capable of cushioning and protecting said knee area from potential injurious falls which could be sustained while utilizing an athletic device.

* * * * *